US005967738A

United States Patent [19]

Warthold

[11] Patent Number: 5,967,738

[45] Date of Patent: Oct. 19, 1999

[54] APPARATUS FOR REMOVABLY CONNECTING AN IMPLEMENT TO VEHICLE POWER ARMS

[76] Inventor: Jürgen Warthold, Beckumer Strasse 34, 59229 Ahlen, Germany

[21] Appl. No.: 08/919,357

[22] Filed: Aug. 28, 1997

[30] Foreign Application Priority Data

Feb. 15, 1997 [DE] Germany ..... 297 02 648 U

[51] Int. Cl.[6] ..... E02F 9/00

[52] U.S. Cl. ..... 414/723; 37/468

[58] Field of Search ..... 414/723; 37/468; 212/292

[56] References Cited

U.S. PATENT DOCUMENTS 3,705,656 12/1972 Hunger et al. ..... 414/723

5,049,027 9/1991 Morrison et al. ..... 414/723

5,403,144 4/1995 Staben, Jr. ..... 414/723 X

*Primary Examiner*—Donald W. Underwood

*Attorney, Agent, or Firm*—Burns, Doane, Swecker & Mathis, L.L.P.

[57] ABSTRACT

A skid loader includes forwardly projecting power arms. A carrier frame is hingedly mounted to the power arms by pivot pins and is adapted to support a working implement. The working implement is connected to the carrier frame by locking pins movably disposed on the carrier frame. The locking pins are actuated by a hydraulic device which is supplied with hydraulic fluid by a fluid passage, a portion of which passes through a pivot pin.

15 Claims, 4 Drawing Sheets

APPARATUS FOR REMOVABLY CONNECTING AN IMPLEMENT TO VEHICLE POWER ARMS

SUMMARY

Figure 1:
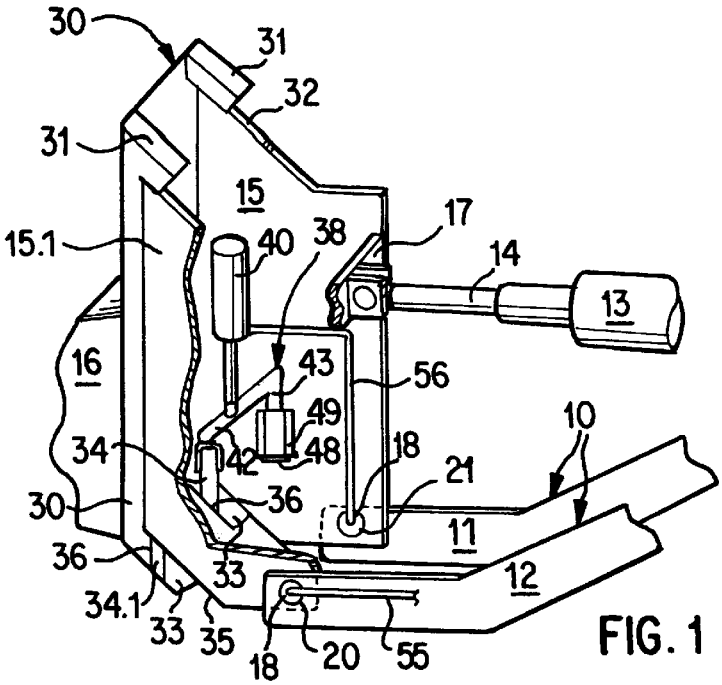

The purpose is to improve a lift truck having two power arms for elevating and lowering which are energized by an onboard hydraulic system and on the forward ends of which arms, an implement frame is hingedly affixed by means of pivot pins, and said frame possesses means for the securement of said installed implement as well as locking pins for a latch-in, latch-out procedure. The improvement lies therein, that a rapid and safe deposition, change, or lifting of a load is possible wherein a.) each of the locking pins is movable with the help of a pressure cylinder, b.) each of the locking pins is made movably active by the hydraulic fluid, which locking pins receive said hydraulic fluid through an axial boring in at least one pivoting pin, and c.) by which pivoting pins, the implement frame and the power arms of the lift truck are hingedly linked.

THE AREA OF THE INVENTION

The invention concerns a lift truck with two, hydraulically actuated power arms for lifting and lowering. On the forward ends of said arms, a carrying frame is hingedly affixed by means of pivot pins for the acceptance of operational implements. The means of securing the installed implements are comprised of locking pins which allow engagement or disengagement of said implements.

The lift trucks involved are typified by, for instance, a small pick up and transport vehicle, which, on the front end of the power arms shows a substantially vertical carrying frame for operational implements, which frame is hingedly fastened to said arms by horizontal pivot pins. The frame can be pivoted by mechanical connection to a hydraulic cylinder.

The frame enables the placement thereon of various working implements, namely gripping tongs, forks for pallets or refuse material, gravel scoops, or the like. These implements are secured by means of locking pins inserted in aligned borings in the outer periphery of the carrying frame and in corresponding locations of the implement.

Technological Background

The hydraulic power arms to lift and lower are extended forward from the area behind the cab and are located immediately at each side thereof. This gives rise to substantial danger to the driver which forced incisive safety procedures. The operator's cab is, at each side, covered with a wire netting, a contact switch in the seat, as well as other devices, make sure that the lift truck, inclusive of the hydraulic and lift/lower mechanism is without motion if the operator rises from his seat. Since the locking pins must be inserted and removed by hand, consequently the driver, in order to change, remove or install an implement must leave the lift truck, manipulate the locking pins, and then again mount into the cab. While he is out of the cab, then the hydraulic is shut off by the seat switch. This operation is, accordingly, time consuming and because of the entry-reentry, is also fraught with danger.

Thus the purpose of the invention is, to so improve the equipment of the conventional type, that a rapid and safe change, removal or installation of the implement is possible.

A BRIEF DESCRIPTION OF THE INVENTION

The locking pins can be activated by means of the pressure cylinder with the fluid of the branched hydraulic system. One pressure cylinder suffices for one coupled group when mechanically joined locking pins are used. If mechanical joining is not employed, then one pressure cylinder must be put in place for each locking pin. From the hydraulic cylinder(s), the hydraulic fluid is fed through borings in the implement carrier frame to the pivoting pins in the lift-arms. This permits firm transfer connections on the outer side. Inside the implement carrying frame, unbalanced movements can be equalized by means of tube connectors. Advantageous in this case, are rotatable sleeve connections. This gives consideration to the rough operation of a lift truck in operation. This way, the required hydraulic fittings for the connection of the pressure cylinder(s) are kept free from damage.

Further, impairment of the view of the driver is removed.

By means of the accessibility of the locking pins from the seat of the lift truck, leaving the driver's seat is no longer necessary for the change, removal or installation of an implement. The seat switch is no longer opened, and the hydraulic system is not cut off. If the implement carrying frame is correspondingly positioned in regard to the implement to be affixed, and if the carrying frame has grasped it, then it can be immediately locked in place.

A SHORT DESCRIPTION OF THE FIGURES

FIG. 1 shows, in a schematic side view, the front area of a lift truck (truck omitted), the power arms of which truck are provided with a framing to receive a working implement. On this frame an implement (indicated by a broken outline) is affixed by a transition piece and, by means of an hydraulically operated apparatus for latch-in, latch-out of said implement, is secured by locking pins.

Figure 2A:
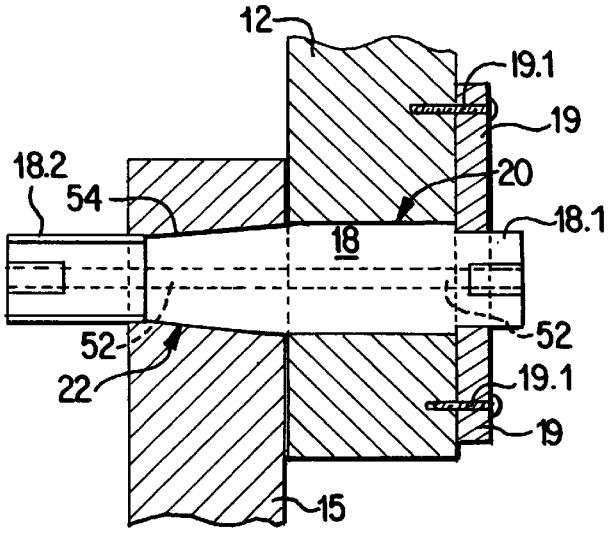
Figure 2B:
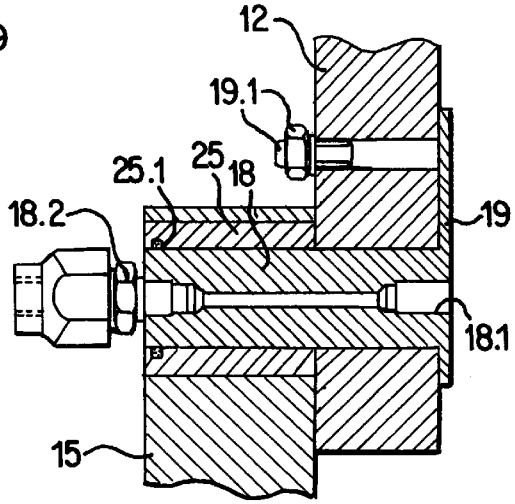

FIGS. 2*a* and 2*b* present the implement carrying frame with simple pivot pins provided with a penetrating boring set into one of the power arms of the lifting apparatus, wherein FIG. 2*a* depicts a conical pivot pin with a straight line, internal hydraulic passage with hydraulic fittings at both ends. FIG. 2*b* shows a cylindrical pin with a pressure chamber and a hydraulic screw-on fitting.

Figure 3:
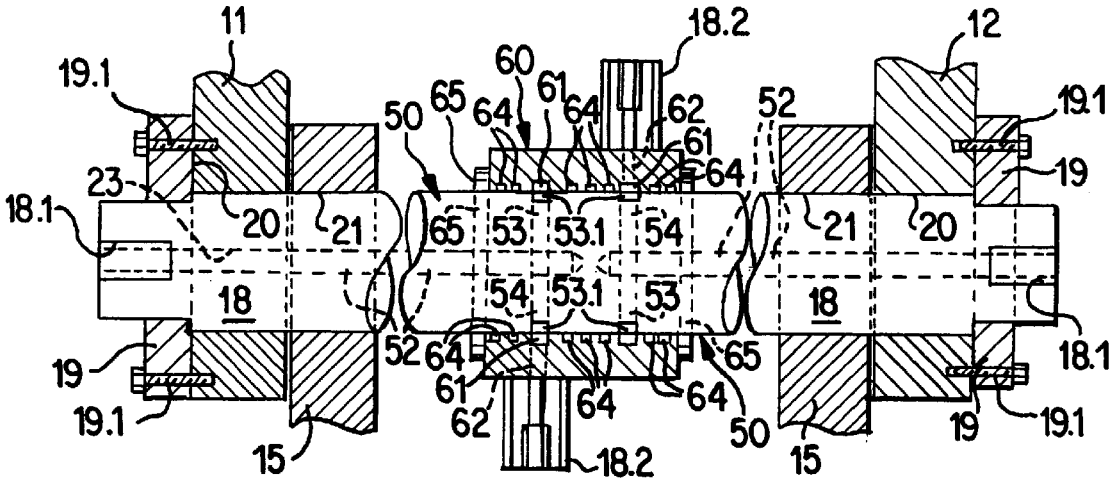

FIG. 3 shows the implement carrying frame with one penetrating pivot pin, installed through the power arms of the lift apparatus, wherein the hydraulic fluid is fed in through blind end borings, directed, one against the other plus radial borings leading to a rotating sleeve connection.

Figure 4B:
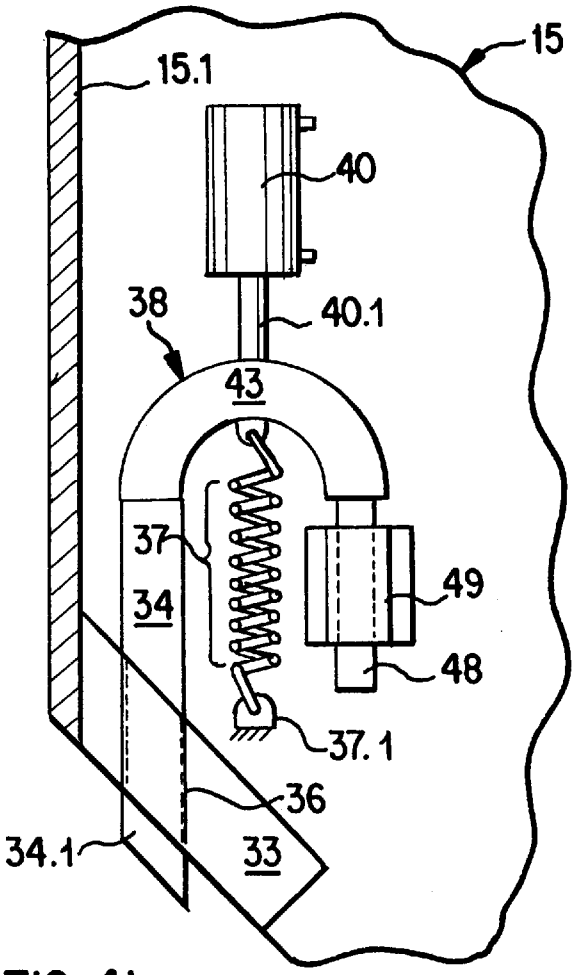
Figure 4A:
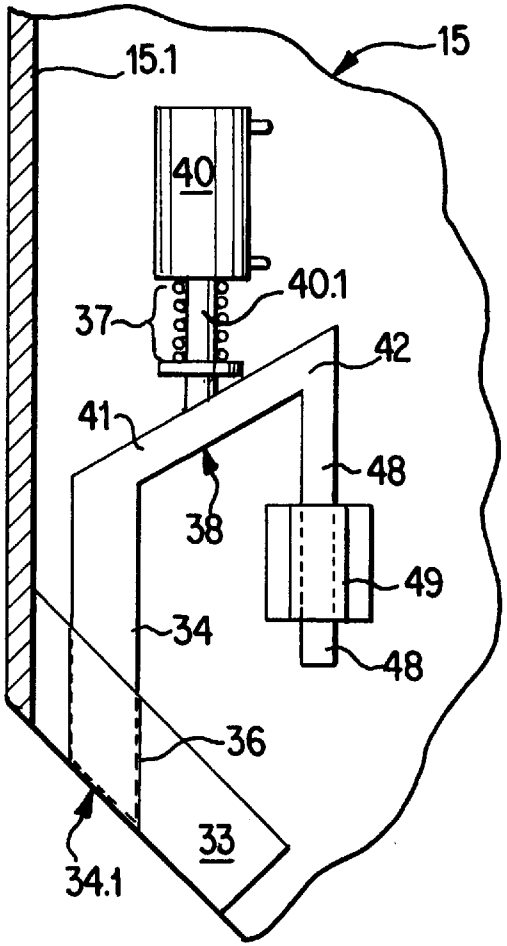

FIG. 4*a* is the V-shaped yoke.

FIG. 4*b* is the U-shaped yoke.

Figure 5:
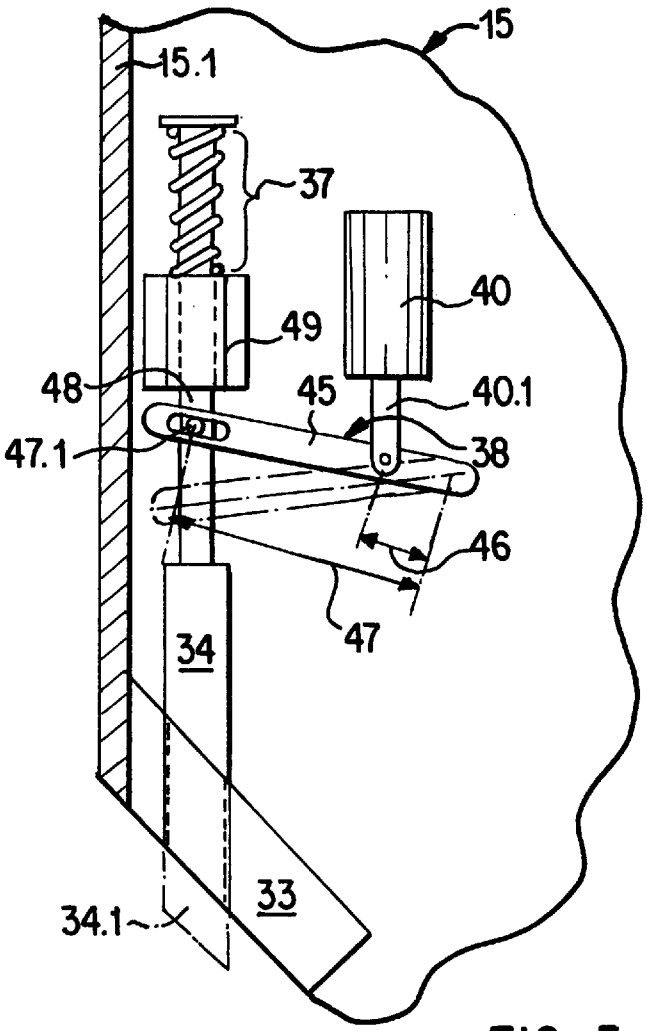

FIG. 5 depicts a detail of the power transmission apparatus with a rocker/lever arrangement as well as the repositioning compression spring.

Figure 7:
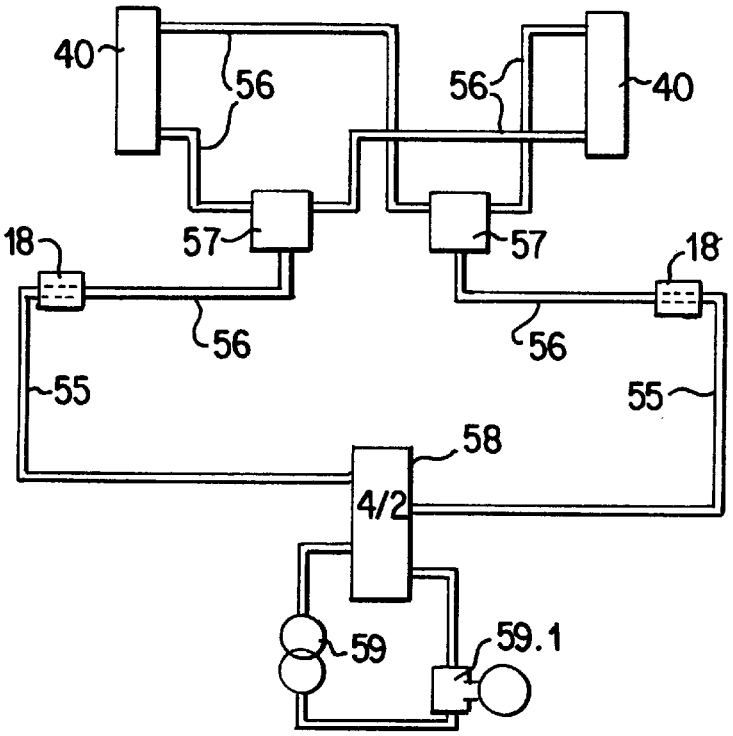
Figure 6:
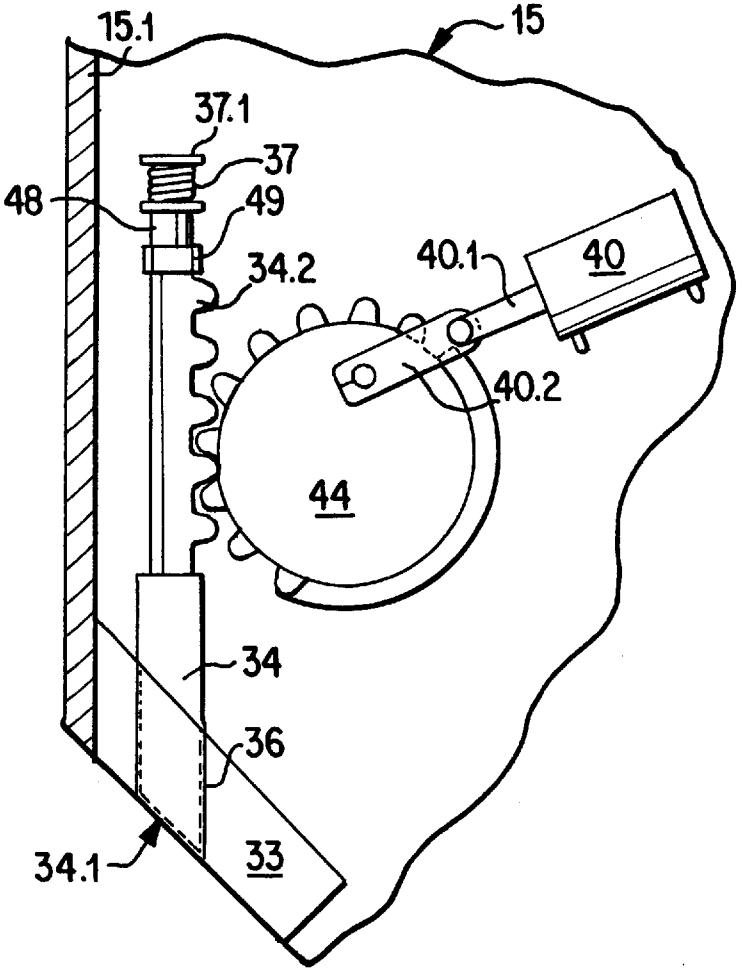

FIG. 6 gives a detail of the power transmission apparatus with a rack and pinion drive and with the repositioning compression spring. Finally, FIG. 7 shows a schematic hydraulic system drawing, but omitting the universal on-board hydraulics.

A DESCRIPTION OF ADVANTAGEOUS EMBODIMENTS

FIG. 1 shows, in a schematic side view, the front area of a lift truck (truck omitted) with an installed lift apparatus 10 having two hydraulic lift and lower arms 11 and 12, of which FIG. 1 shows in detail arm 12, which is on right side as one faces the front of the said lift truck. The left arm 11 shows less detail. On the forward ends of the two power arms 11 and 12 an implement carrier framing 15 is provided, which is hingedly affixed to the power arms (11, 12) by a pivot pin 18 located at right angles to the direction of lift truck travel. The implement carrier frame (15) is rotatable about said pivot pin 18, so that said carrier can be brought into an operating position for either lifting or lowering by a hydraulic cylinder 13 (only schematically shown) which grips with its piston rod a traverse 17 of the implement carrier frame 15.

The implement carrier frame 15 possesses in its upper area, inclined shaping 32 conforming to implement 16, which said implement is provided with a connection piece 30 and grips the implement carrier frame 15 with its retaining hooks 31. On the underside of the implement, connection piece 30 is provided with diagonal struts 33 which fit into a correspondingly inclined under edge 35 of the implement carrier frame 15. Implement carrier frame 15 and connection piece 30 are put in a latch-in, latch-out mode, with the aid of two locking pins 34 set at each side on the implement carrier 15. In this way, the borings 36 in the inclined struts 33 align with the corresponding borings 36 in the area of the under edges 35 of the carrier frame 15, and it is into these borings that the locking pins 34 will be inserted. These pins 34 are pressed, pairwise, into the borings 36 of the diagonal struts 33, so that the locking nose 34.1 can penetrate into this aligned boring 36.

In this procedure, the locking pins 34 can be manipulated by means of pressure cylinder 40 which is connected to the onboard hydraulic system (see FIG. 7) through the hydraulic connections 55 to the pivot pins 18 as well by the control module 58 in the cab for the activation of the locking pins 34. These locking pins 34, because of space saving reasons, are located in the forward zone of the implement carrier frame 15. They are, by means of a power reversal device 38, moved out of a locking position into a released position and vice versa.

The pivot pin 18 is, on each side, conducted through a boring 20 in a power arm (here power arm 12, analogously for power arm 11) and on through a second boring in the side wall of the implement carrier frame 15. The end of the pivot pin 18 which confronts the implement carrier frame 15 is designed with a segment conical in shape (see FIG. 2) which fits with close tolerance into a corresponding conical boring 22 in the implement carrier frame 15. On each side, an external, retaining plate 19 with boring, and affixed with screws 19.1 (only indicated), respectively overlaps the power arm end of each pivot pin 18, which end is reduced in diameter, and so assures maintenance of position for that said pin 18. The end of the pivot pin 18, which is conically received in the implement carrier frame 15 protrudes from said boring. The pivot pin 18 is provided with a through penetrating. axial boring 18.1, which is designed in the power arm side end accepts a screwed hydraulic connection. The receiver side end exhibits, as an exit, a screw fitting 18.2 for a hydraulic coupling.

In another embodiment, the pivot pin 18 is designed as a cylindrical insert member (FIG. 2*b*) A firmly affixed plate 19 holds it in position. The inner end of the pivot pin 18 is rotatably seated in a bushing 25 and sealed against loss of grease by a stuffing means 25.1. The inner end of this said pin is further provided with a screwed in hydraulic fitting 18.2 to which a flexible tube is connected, by means of which, the hydraulic fluid is conducted to the pressure cylinder 40.

If, in the case of relatively narrow lift trucks, a completely penetrating pivot shaft 50 is provided, then the ends thereof form the pivot pins 18, which are inserted through the borings 20 or 21 of the power arms 11 and 12 as well as through the side walls of the implement carrier frame 15. Because of the single penetrating, cylindrical pin boring, both reduced diameter ends of the pivot pins 18 are secured by retaining plate 19 and with screws (only indicated) 19.1. The implement carrier frame 15 is hingedly linked onto the power arms with these pivot pins 18.

The hydraulic feed is analogous: If the pressure cylinder 40 is single action, then one axial boring 52 is sufficient.

If the pressure cylinder 40 is double action, then a pair of borings in opposite axial direction to one another are provided, whereby it is obvious, that the hydraulic exit ports from the pivot shaft 50 are correspondingly equipped. Thus, in the simplest case, the exit connections 18.2 are installed directly at the opening positions of the radial borings 53 which are set on the outer casing of the pivoting shaft 50. Of advantage is a rotatable exit fitting sleeve 60,which circumferentially encompasses the continuous pivot shaft 50 in the area of the of the radial borings 53 which open into grooves 53.1 and which enables an uncoupling of the pivoting movement. This removal sleeve 60 can exhibit ring grooves 61 corresponding to the ring grooves 53.1 of the pivot shaft 50, which in turn are connected by radial borings 62 to the hydraulic exit screw connection ports 18.2 which are installed upon the outer surface of the removal sleeve 60. Internal ring sealant means assure that the grooves 53.1/61 are tight against each other, as well as tight against the outer environment. Washer type blocking disks 65 on both sides assure the position of the removal sleeve 60.

Because of the limited space relationships in the front area of a lifting truck, with implement carrier framing 15 hingedly linked on the power arms 11 and 12, it is advantageous to arrange the motion axes of the locking pins 34 parallel to the piston rod 40.1 of the pressure cylinder 40. This permits an arrangement of the locking pins 34 independently of the pressure cylinder 40 near the front side of the implement carrier framing 15. For the power transmission from the pressure cylinder 40 to the locking pins 34, advantageously, a power reversal apparatus 38 has been provided.

In this matter, that is, of the power reversal apparatus, a mechanical structure in the form of, respectively, a V-shaped yoke (FIG. 4*a*), a U-shaped yoke (FIG. 4*b*) with a counterpoised simple lever (FIG. 5). Compound levers can be accordingly used, without limitation thereof.

The lock-in apparatus 38 with locking pins 34, shows a hydraulic pressurized cylinder 40, (here shown as single acting) which cylinder is fastened and reinforcingly supported on the implement carrier frame 15. This cylinder 40 is connected to the on-board hydraulic system of the lift truck over the hydraulic lines 56 as well as 55. In order to arrange the locking pins 34 in the absolute front part of the implement carrier frame 15, the axis of the pressure cylinder is installed parallel to that of the locking pins 34, which are activated by the power transmission (or lock-in) apparatus 38.

For the sake of synchronization of the movement of the locking pins 34, both the hydraulic lines 56 (See FIG. 7) which feed the pressure cylinder 40, emanate from the output ports of respective hydraulic apportionment means 57 which means is inserted in the line following the hydraulic exit port 18.2. In the case of a single acting pressure cylinder, the unlocking movement is controlled by pressure and the locking movement is activated by one of the locking movement return springs, wherein the spring can also be located in the pressure cylinder assembly.

In one embodiment of the power transmission apparatus 38, the movement of the pressure cylinder 40 is transferred on a V-shaped yoke, which is connected to the piston rod 40.1 of the said pressure cylinder 40. The one leg 41 of the yoke extends to the locking pin 34, while another leg of the same 42 shows a guide bar 48 arranged parallel to the locking pin 34, which, to avoid canting or hang-up moves in a guide enclosure 49. In another embodiment, the yoke is U-shaped in structure. The apex of the U-bend 43 is connected to the piston rod 40.1 and transfers the motion of said rod to the locking pins 34 and the guide bar 48.

In yet another embodiment of the power transmission apparatus 38, the motion of the pressure cylinder is transferred over a counterpoised lever arrangement 45. In this case, the piston rod 40.1 acts upon the short arm 46 of a simple lever, the longer lever arm 47 of which operates in conjunction with the locking pin 34. Because of the pivoting movement about the fulcrum of the lever, here the locking pin 34 is pivotally connected to the lever by means of a slide ring guided in slit 47.1, compensating for the radial to linear motion. In both cases, the length relationship of the two lever arms 46 and 47 defines the transfer of power and travel. A short thrust cylinder requires a short lever arm 46. At the same time, for the locking pins 34 on the long lever arm, the longer path for unlocking is possible, and the necessary greater power can be obtained from the hydraulic cylinders. In order to prevent interfering, and thus undesired hang-ups in the movement of the locking pins, the guide 49 is designed to compensate for this. The guide 49, wherein guide bar 48 moves, possesses an axis parallel to the axis of the locking pin. This parallelism is important for a disturbance free operation. In this way, lateral movement is avoided. although even without lateral displacement, a guidance means, as shown in FIGS. 5, 6, can prevent jamming.

A further possibility of the transfer of power lies in the rack and pinion drive. In the presentation chosen, the pressure cylinder 40 acts through the piston rod 40.1 and a coupling shackle 40.2 connected to a gear wheel 44, whereby the shackle 40.2 is eccentrically linked to the gear wheel 44. The gear wheel 44 interacts with the locking pin 34.1 which is extended as a gear rack 34.2. When the pressure cylinder (in the presentation—FIG. 6—shown as extended) is pressurized, then the piston rod 40.1 extends outwardly and carries along the coupling shackle 40.2. This turns the gear 44 counterclockwise. In this way, the rack 34.2 of the locking pin, as well as the locking pin itself are brought into the locking position. The unlocking is done in reverse order. With such a gear transmission, the travel and power can be adapted to suit the local requirements of an application, wherein the axes of the pressure cylinder 40 and the locking pin 34 can also lie angularly displaced to one another. Obviously, in this way, instead of a single gear wheel being interposed, also a chain of several gears can be provided. Further, also in this case a jamming prevention guide 49 is provided, namely, the extension 48 of the locking pin 34 is thereby guided.

Advantageously, the power reversal apparatus is provided with a power storage means. This becomes compressed upon locking and which, upon the loss of hydraulic pressure maintains the locking pin in—or transfers it to—the locked position. With this feature, an unexpected release of a raised implement upon loss of hydraulic system pressure is prevented, thus improving the operational safety. Such a power storage is, for instance, a spring 37. For the unlocking, the pressure cylinder 40 is pressurized, whereupon the piston rod 40.1 withdraws, lifting the yoke with its side 42, or, in the case of the U-bow 43, and also lifting the locking pin out of the boring 36 in the connection piece 30 of the implement 16. Upon the motion of the thrust of the piston rod 40.1, for instance, a spring within the pressure cylinder will be compressed, so that sufficient force is available for the locking of the implement 16 in position by means of the locking pins 34. This is the case then, during a failure of hydraulic system pressure or loss of pressure to the pressure cylinder. If the hydraulic cylinder 40 is designed as a double action cylinder, then the piston itself can be exposed to pressure from both sides with hydraulic fluid. In this case, the unlocking of the locking pins 34 can be effected by withdrawal as previously described, as well as the locking by means of hydraulically setting the locking pins 34.

In order to bring, or hold, the locking pin 34 in its locked position upon pressure loss or hydraulic failure, externally arranged springs 37 are advantageous and so located that they can be monitored. Such springs are backed up by a fixed washer or plate 37.1, thus at one end affixed to the structure, to act on a movable part of the power reversal apparatus 38. In FIG. 4*a,* the spring 37 is a compression spring which is compressed upon locking, and which, upon loss of pressure, expands and presses the yoke with the locking pin into the locking position. In FIG. 4*b* the spring 37 is designed as a tension spring, which grips upon the bow 43 of the yoke and upon unlocking, retracts upon itself. Upon loss of pressure, this spring 37 draws the yoke with locking pins into the locked position.

FIG. 5 and FIG. 6 show the spring 37 which interacts with the extension 48 of the locking pin 34. In FIG. 5, this spring is designed as a tension spring, and with its secured end fixed on the guide 49, while the free end is connected with the extension 48 with the movement of which, said spring is carried along. In this case, this spring 37, upon unlocking is recognizably extended and so in tension. In FIG. 6, the spring is designed as a compression spring, with its fixed end on an abutment washer 37.1 fixed to the structure while its free end is carried along with the head of the extension 48 of the locking pin 34. Obviously, in this case the spring 37 is pressed together upon unlocking, i.e. compressed. Upon hydraulic or pressure failure, the compressed spring 37 releases itself and forces before it the locking pins 34 into the locking position.

FIG. 7 presents, finally, the schematic piping diagram of the on-board hydraulic system with attached pressure cylinder 40 for the locking—unlocking of the implement with the help of the locking pins 34. Hydraulic fluid is propelled from the hydraulic pumps 59 of the on board system into an accumulator 59.1, which has available several exit ports, (here only one is shown). The hydraulic cylinders 40 for locking—unlocking of an implement are here regulated by a 4/2 control valve 58. The said control valve 58 feeds the connection line 55 with the hydraulic fluid under pressure through the axial boring 52 in the pivot pins 18 and the hydraulic connection line 56, as well as the pressure cylinder 40 over the hydraulic apportioner 57, which possesses two branches. The pistons are accordingly put in motion and the piston rods 40.1 (see FIG. 1) are withdrawn or extended. The release of pressure by reversal of the valve 58 reverses the direction of movement (if necessary, by the internal springs) and allow the pistons to return to their original positions.

I claim:

1. An implement carrier apparatus for a vehicle, comprising:

a pair of forwardly projecting power arms;

a carrier frame hingedly mounted to the power arms by respective pivot pins;

a locking element movably mounted on the carrier frame and adapted to be actuated to a locking position for connecting a working implement to the carrier frame;

a hydraulic locking element actuator mounted on the carrier frame and connected to the locking element;

a hydraulic passage for supplying hydraulic fluid to the hydraulic locking element actuator, the passage passing through at least one of the pivot pins.

2. The carrier apparatus according to claim 1 wherein the actuator comprises a hydraulic pressure cylinder and a movable piston rod carried by the pressure cylinder, the piston rod operably connected to the locking element.

3. The carrier apparatus according to claim 2 wherein the locking element is arranged to move along a first axis, the piston rod arranged to move along a second axis parallel to the first axis, and a power transmission element connecting the piston rod to the locking element.

4. The carrier apparatus according to claim 3 wherein the power transmission element comprises a yoke having first and second legs, the first leg attached to the locking element, and the second leg arranged to move along a third axis disposed parallel to the first and second axes, and a guide fixed to the carrier frame for guiding the movement of the second leg.

5. The carrier apparatus according to claim 2, further including a lever pivotably mounted to the carrier frame, the lever being pivotably mounted to the locking element and to the piston rod, whereby movement of the piston rod produces rotation of the lever and movement of the locking element.

6. The carrier apparatus according to claim 2 wherein the locking element comprises a toothed rack, the actuator including a toothed pinion mounted for rotation and meshing with the rack, the piston rod connected to the pinion for rotating the pinion.

7. The carrier apparatus according to claim 1 wherein the at least one pivot pin has an axial through-bore with screw threaded fittings disposed at opposite ends thereof for receiving hydraulic conduits.

8. The carrier apparatus according to claim 7 wherein the hydraulic actuator is a single-acting hydraulic cylinder/piston structure.

9. The carrier apparatus according to claim 7 wherein each of the pivot pins contains a hydraulic passage, the actuator comprising a double-acting hydraulic cylinder/piston structure.

10. The carrier apparatus according to claim 1 wherein the pivot pins are formed by respective ends of a single shaft connected to both of the power arms.

11. The carrier apparatus according to claim 10 wherein the hydraulic passage extends through one of the pivot pins and forms a fluid outlet situated between opposite ends of the shaft, the actuator comprising a single-acting hydraulic cylinder/piston structure.

12. The carrier apparatus according to claim 11 wherein there are two of the hydraulic passages passing through respective ones of the pivot pins, each hydraulic passage forming a fluid outlet located between opposite ends of the shaft, the actuator comprising a double-acting hydraulic cylinder/piston structure.

13. The carrier apparatus according to claim 12 further comprising an exit sleeve mounted on the shaft, the exit sleeve and the shaft being relatively rotatable, the exit sleeve comprising a pair of fluid exits and a pair of internal ring grooves, each ring groove connecting one of the fluid outlets with one of the fluid exits.

14. The carrier apparatus according to claim 1 further including a spring for biasing the locking element to the locking position, the actuator arranged to move the locking element out of the locking position against a bias of the spring.

15. The carrier apparatus according to claim 1 wherein the locking element comprises a locking pin.

* * * * *